US005169005A

United States Patent [19]

Beane

[11] Patent Number: 5,169,005

[45] Date of Patent: Dec. 8, 1992

[54] APPARATUS FOR SEPARATING MATERIAL OF LIGHTER SPECIFIC GRAVITY FROM MATERIAL OF A HEAVIER SPECIFIC GRAVITY

[76] Inventor: William F. Beane, P.O. Box 122, Charleston, W. Va. 25321

[21] Appl. No.: 652,019

[22] Filed: Feb. 7, 1991

[51] Int. Cl.[5] ..... B03B 5/40

[52] U.S. Cl. ..... 209/172.5; 209/155; 209/173

[58] Field of Search ..... 209/17, 155, 156, 172, 209/172.5, 173

[56] References Cited

U.S. PATENT DOCUMENTS

| | | | |
|---|---|---|---|
| 2,516,962 | 8/1950 | Davis | 209/172.5 |
| 2,521,152 | 9/1950 | Davis | 209/173 X |
| 2,696,300 | 12/1954 | Maust | 209/172.5 |
| 2,825,459 | 3/1958 | Schuetz | 209/172.5 |
| 4,409,098 | 10/1983 | Burke | 209/172.5 |

FOREIGN PATENT DOCUMENTS

| | | | |
|---|---|---|---|
| 0149964 | 12/1950 | Australia | 209/173 |
| 0156283 | 7/1951 | Australia | 209/172.5 |
| 0200572 | 2/1955 | Australia | 209/172.5 |
| 1172124 | 2/1959 | France | 209/173 |
| 0754895 | 8/1956 | United Kingdom | 209/172.5 |

*Primary Examiner*—Joseph E. Valenza
*Attorney, Agent, or Firm*—Scott R. Cox

[57] ABSTRACT

A device for separating material of lighter specific gravity from material of a heavier specific gravity. The device is comprised of a generally semi-cylindrical outer tank comprised of end walls and a semi-cylindrical bottom portion, a material introducing system to introduce the material to be separated into the outer tank, a medium introducing system to introduce media into the outer tank under pressure, a baffle system secured within the outer tank containing sides wherein the sides project above the surface of the medium within the tank when the baffle system is secured to the end walls of the semi-cylindrical tank, a paddle drum system comprised of an generally cylindrical inner tank and paddles secured thereto and a drive system secured to the support system of the device wherein the drive system rotates the paddle drum system. This device is for the separation of material having lighter specific gravity from material of a heavier specific gravity by permitting the flow of the material in the medium across the system to be uninterrupted by the operation of the removal of waste from the bottom portion of the outer tank and by continual sweeping the bottom of outer tank, keeping the medium well mixed to insure a consistent specific gravity throughout the outer tank.

15 Claims, 5 Drawing Sheets

APPARATUS FOR SEPARATING MATERIAL OF LIGHTER SPECIFIC GRAVITY FROM MATERIAL OF A HEAVIER SPECIFIC GRAVITY

BACKGROUND OF INVENTION

1. Field of Invention

This invention relates to devices for separating materials having different specific gravities. More specifically, this invention relates to a device for separating coal from waste material by liquid separation.

2. Prior Art

It is an important element in the mining and processing of coal and other solid material that rock and other waste material be removed from the raw product. For example, a well known procedure to separate usable coal from waste in raw coal is to pass the raw coal through a separation tank containing a liquid media which supports material with a selected specific gravity. When a specific liquid medium is used, the raw coal tends to float on the surface of the tank and flows through the separation tank without sinking. Waste material generally sinks to the bottom of the tank where it is collected and removed.

Several patents disclose devices for the washing and separating of coal or other solid material. For example, U.S. Pat. No. 4,409,098, Burke, discloses an apparatus for separating coal from raw coal using a liquid bath. This patent discloses a device useful in the separation of coal from raw coal wherein the raw coal is introduced into a liquid medium flowing across a separation tank between two pairs of baffle plates. See FIG. 2. The heavier waste material falls to the bottom of the device and is removed from the tank by a paddle wheel system wherein the arms of the paddle wheel system run through the flow of the liquid medium and between the two pairs of baffle plates.

Other devices for either the removal of material by a separatory procedure or for the washing of ore itself are disclosed in several patents. For example, U.S. Pat. No. 242,035, Peirce, discloses a semi-cylindrical box which receives ore at one end. Blades on a shaft move the ore towards the end of the box while flowing water carries off lighter material through discharge openings. The heavier material is picked up by shovels which dump this material over the sides of the box.

U.S. Pat. No. 246,706, Barber, et al., discloses a rotating wheel ore washer having buckets which are pivoted loosely such that the buckets pick up material in the bottom of a tank. As each bucket descends into the tank during rotation of the wheel, it is moved into engagement with certain projections which are secured to the opposite side of the tank to permit the removal of waste material from the tank.

U.S. Pat. No. 648,262, Honecker, discloses a coal separator containing a rotating shovel assembly for the removal of slate from a coal wash. Water is forced up through perforations in the bottom of the device to cause the coal to flow into a chute while the slate on the bottom is conveyed by an inclined shelf to a trough where it is lifted from the water by rotating buckets which discharge slate through openings into a tray.

U.S. Pat. No. 986,581, Long, discloses a complicated drum mechanism for the separation of material. Wash water is continually introduced into the interior of the drum to wash the light, worthless material toward the bottom of the drum while the heavier valuable constituents adhere to the lining of the drum.

U.S. Pat. No. 3,019,900, LaGrost, discloses a washing table or vat having a weir over which floating material passes into a draining chute. The vat has a bucket lifting wheel mounted for rotation about a horizontal axis and positioned so that the lower part of its path of travel is through the vat. The wheel picks up zinc material in the bottom and causes the zinc material to be directed inwardly against an outer surface plate from which it falls into a discharge chute.

U.S. Pat. Nos. 2,825,459 and 2,825,460, Schuetz, disclose devices for the washing of coal which remove heavier material from the coal as it falls to the bottom of a tank by use of rakes which move back and forth within the device.

U.S. Pat. No. 2,899,058, Tromp, discloses a complex apparatus for separating granule material having different specific gravities. The apparatus is disclosed of a solid drum-like cylinder containing vertical walls projecting from the sides of the cylinder through which the material is directed and blades for the removal of heavier material which drops to the bottom of the apparatus.

U.S. Pat. No. 3,493,108 discloses a device useful to increase the concentration of asbestos ore. It uses an oscillating sweeper for the removal of material that falls to the bottom of the device. See FIG. 5.

These patents disclose a number of devices useful for the removal of waste from coal and other solid separation procedures. However, there are certain problems that have not been solved by the prior art. For example, it is imperative for the full and complete separation of the usable coal from the waste that the liquid medium be undisturbed as it flows from one side of the separator to the other. Interruption of this flow occurring during the removal of the waste from the apparatus causes a reduction in the efficiency of separation. Any portion of the apparatus which moves through the flow of the coal can cause the coal to fracture or be carried to the bottom of the apparatus and thus be removed with the waste material. In addition, the less contact of the moving parts of the apparatus with the material flowing through the separator, the less damage will occur to the system. Thus, although there are many useful devices disclosed in the prior art for separation of coal, there is still a need for an improved apparatus for separating lighter specific gravity material from material having heavier specific gravity.

Therefore it is an object of this invention to provide a device for the separation of material of lighter specific gravity from material of heavier specific gravity.

It is another object of this invention to provide a new and unique apparatus for the separation of material of different specific gravity using a liquid medium wherein said medium is not disturbed by that portion of the apparatus which removes the waste.

It is a still further object of the invention to provide an apparatus for the separation of material of different specific gravity using a liquid medium where the down time of the apparatus is reduced because of the reduction or elimination of interference with the flow of the material by that portion of the apparatus which removes the waste.

These and other objects and features of the present invention will become apparent to those skilled in the art from a consideration of the following detailed description, drawings and claims. The description along with the accompanying drawings provide a selected example of construction of the device to illustrate the invention.

SUMMARY OF THE INVENTION

In accordance with the present invention there is provided an apparatus for separating material of lighter specific gravity from a material of heavier specific gravity comprising (a) a semi-cylindrical outer tank comprised of end walls and a generally semi-cylindrical bottom portion wherein said tank is supported by a support system, (b) a material introducing system to introduce the material to be separated into said semi-cylindrical outer tank, (c) a medium introducing system to introduce the medium into said semi-cylindrical outer tank, (d) a baffle secured within said outer tank wherein said baffle contains walls and a bottom portion, wherein said walls project above the surface of the medium within the outer tank, and wherein the walls of said baffle extend between the end walls of the semi-cylindrical outer tank, and are secured to the end walls of the semi-cylindrical outer tank, and wherein said baffle contains a discharge opening in the bottom portion of said baffle, (e) a paddle drum system comprised of a generally cylindrical inner tank containing openings therein and a plurality of paddles secured to said inner tank, wherein said paddles do not interferingly interact with the flow of the medium between the sides of the baffle, and wherein said paddle drum system is supported by the support system, (f) a drive system secured to the support system wherein said drive system rotates the paddle drum system.

This apparatus for the separation of material having lighter specific gravity from material of heavier specific gravity provides a new and useful mechanism, for example, for the removal of waste material from raw coal. Its operation permits raw coal to be separated without interruption by the device which remove the waste material from the separator tank. In addition, by separating the flow portion of the process from the waste removal portion, not only is the final product of higher quality with less waste but there is less down time because of less interaction between the flow of the material being separated and the device for the removal of waste material.

BRIEF DESCRIPTION OF THE DRAWINGS

This invention will now be described with reference to the accompanying drawings in which.

DETAILED DESCRIPTION OF THE PREFERRED EMBODIMENT

Figure 1:
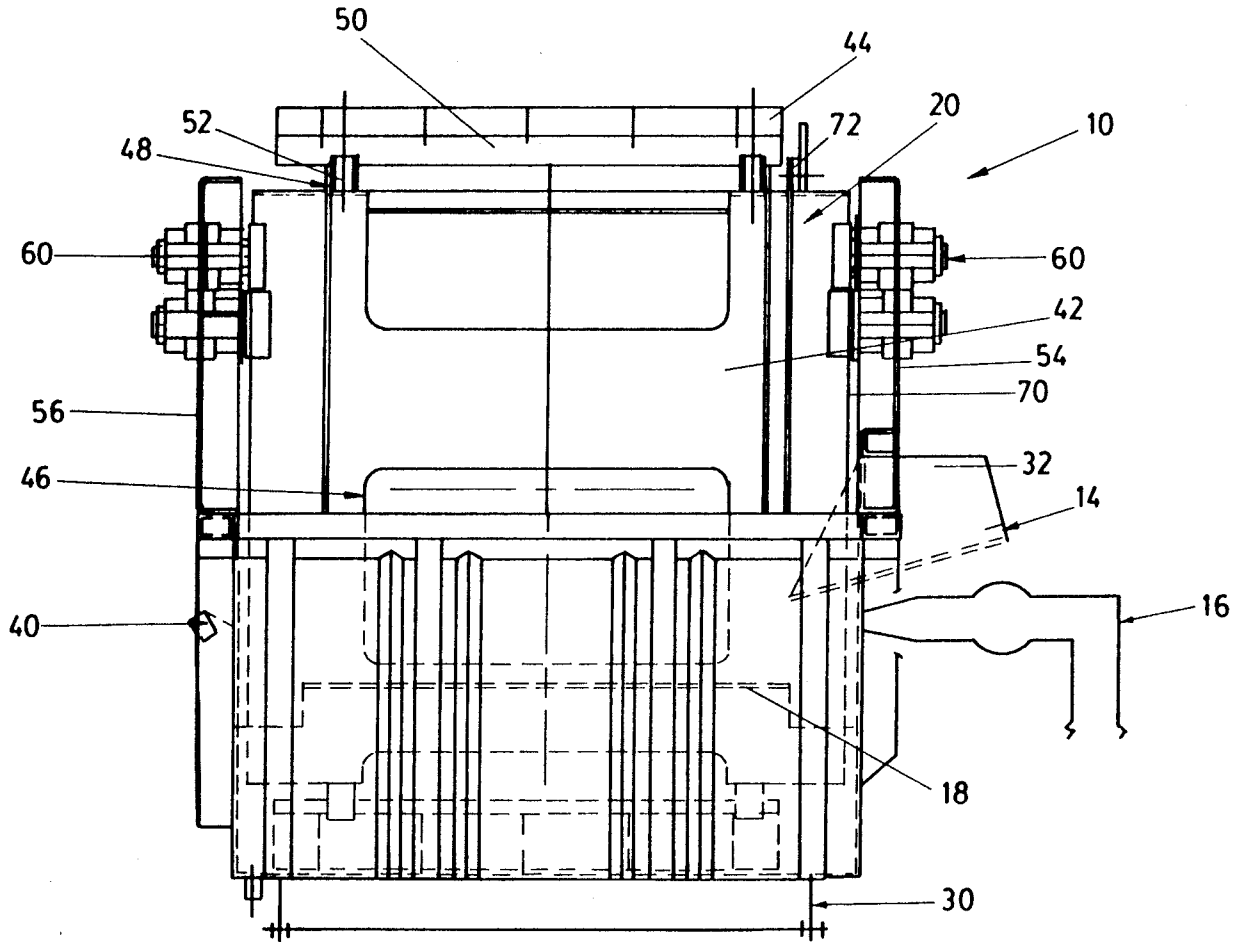
FIG. 1 is a side view of the device with the inlet end on the right side and the discharge end on the left side.
Figure 2:
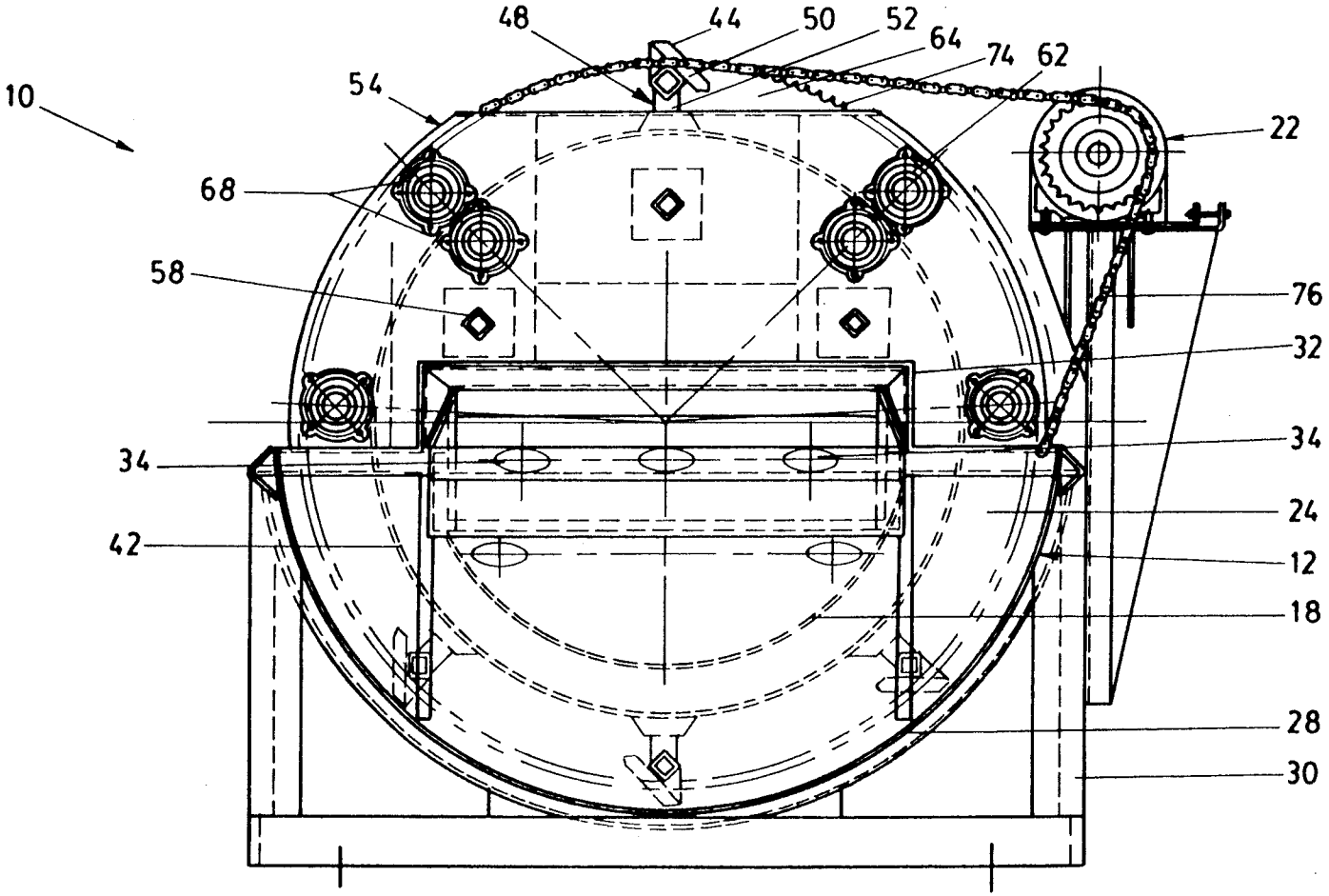
FIG. 2 is an end view of the device from the inlet end.

Although the invention is adaptable to a wide variety of uses, it is shown in the drawings for purpose of illustration as embodied in a device (10) for separation of material of lighter specific gravity from a material of heavier specific gravity comprised of a generally semi-cylindrical outer tank (12), a material introducing system (14), a medium introducing system (16), a generally semi-cylindrical baffle (18), a paddle drum system (20) and a drive support system (22). See FIGS. 1 and 2.

The generally semi-cylindrical outer tank (12) is preferably a semi-cylindrical tank containing two flat end walls (24, 26) closing the ends of the semi-cylindrical outer tank, secured to a semi-cylindrical portion (28). This semi-cylindrical outer tank (12) is supported by and secured to a support system (30) which supports the remaining portion of the device. The support system can be any conventional support structure of sufficient strength to support the weight not only of the outer tank but also the other elements of the device and to permit its operation. A suggested structure is disclosed in the frame assembly of FIG. 1. The semi-cylindrical outer tank itself is constructed of a high strength material, preferably at least about ½ inch thick abrasion resistant steel or in an alternative preferable embodiment, the high strength material is at least about ½ inch steel coated with a material to prevent corrosion during its operation such as a polyurethane coating.

Material to be separated is supplied to the semi-cylindrical outer tank from any conventional source such as a conveyer or a chute in the conventional material processing operation. Although this device can be used for the separation of many types of material, one of its preferred uses is for the separation of coal from waste material in raw coal, as coal has a lower specific gravity than the waste generally associated with coal.

The material to be separated is supplied to the outer tank through the material introducing system. The material introducing system is an inlet chute preferably one-third to four-fifths the width of one end of the outer tank. Its size, proportions, height and depth, can be adjusted as required by the particular separation process. Preferably, the inlet chute is angled downward from above the surface of the tank at an angle of at least 10° but no more than about 45°. See FIG. 2. If the inlet chute is angled at too great an angle the material will fall too deep into the bath and separation will not be as effective. The angle of the inlet chute permits the material to be separated to enter the semi-cylindrical outer tank under the influence of gravity without backing up in the inlet chute. Although the system as disclosed in the drawings shows a single inlet chute, multiple inlet chutes can, of course, be used and, in addition, these chutes can be stacked on top of each other to permit the introduction of different types of materials into the separation system at the same time. All of these alternative embodiments are included as elements of the invention.

It is understood that prior to processing of the material by the device in a preferred embodiment the material is presorted to remove undesired sizes, such as fines, with such presorting preferably accomplished by a screen. The size of the opening in the screen used will depend on the amount of preliminary separation required. In a preferred operation the screen is at least about ⅛ of inch or greater in mesh size.

After the material is placed within the inlet chute, it falls into the medium that has been supplied into the outer tank by the medium introducing system (16). As will be discussed in more detail later, a portion of the medium used in the system is introduced through the inlet chute (32) to assist in the introduction of the material into the outer tank (12). The medium is introduced into the outer tank through medium introducing openings (34) in one of the end walls (24) of the outer tank. See FIG. 2. The number of these medium introducing openings (34) is not particularly critical but should be at least about two to six or more. The size and shape of these medium introducing openings is again not critical, but preferably the medium introducing openings are oval to permit the medium to be distributed into the outer tank evenly and easily. As previously discussed one and preferably at least two medium introducing openings direct the flow of the medium down the inlet chute. The medium is supplied to the openings through a pressurized manifold system through pipes or other systems attached to the introducing system. The specific design and arrangement of these pipes for introducing and distributing the media is well known in the industry and is not described further herein.

The medium introducing openings (34) are located in the end wall (24) of the outer tank so that the medium is introduced into the top portion of the bath within the outer tank. The pressure on the media is controlled so that it creates a consistent horizontal flow toward a discharge opening (40) in the opposite end wall of the outer tank between the walls (38) of the baffle. As previously discussed, a portion of the media is introduced through medium introducing openings in the inlet chute with the remaining portion introduced through medium introducing openings at or near the level of the tank. See FIG. 2.

The medium used for separating the material is carefully chosen so that the desired lighter weight material will float on the top of the medium and the heavier waste material will sink to the bottom of the outer tank. The types of media used are well known in the industry, especially for the separation of coal from waste products in raw coal. For example, to separate coal from raw coal. a mixture of water and magnetite, a magnetized iron ore, is used as the medium. The concentration of the magnetite in the bath is varied depending upon the specific separation sought by the media. The flow rate of the media into the system may also be regulated to increase or decrease the speed of the passage of the media across the outer tank. The rate of the flow should be controlled to reduce the amount of turbulence that is created but still be sufficient to continue the horizontal flow of the media from one end wall to the other end wall of the outer tank. As will be discussed in more detail, the paddles of the paddle drum system assist in keeping the media well mixed without creating harmful turbulence in the surface of the tank.

Figure 3:
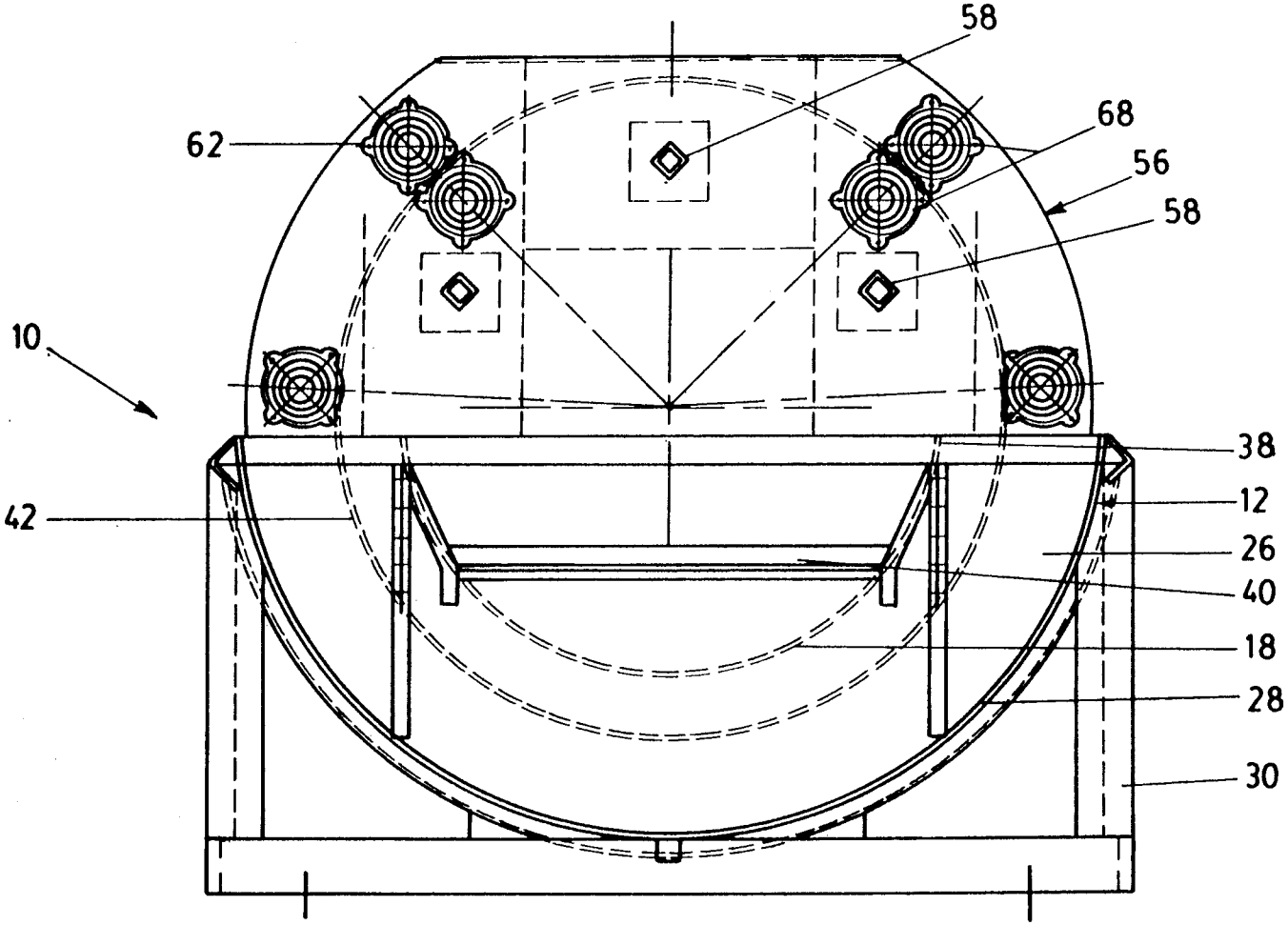
FIG. 3 is an end view of the device from the discharge end shown without paddles.

The generally semi-cylindrical baffle (18) is secured within the outer tank (12) to the end walls of the outer tank. It is generally semi-cylindrical in shape without end walls and contains a baffle opening (36) in the bottom which permits waste material to fall through the baffle opening and descend to the bottom of the outer tank. The walls of the baffle (38) extend above the level of the bath when the outer tank is filled with medium to create a pathway for the flow of the material to be separated across the outer tank. The baffle is placed within the tank in a location such that its walls (38) are aligned with the walls of the tank itself. See FIG. 3. The edges of the baffle walls extend at least about 12–18 inches above the surface of the medium when the outer tank is filled. The distance between the walls of the baffle is less than the diameter of the outer tank, creating a space sufficient to permit the paddles of the paddle drum system to pass between the walls (38) of the baffle and the inside of the outer tank as will be discussed in more detail later. See FIG. 3. The baffle (18) is secured within the outer tank by any conventional method and preferable the ends of the baffle are welded to each end wall (24, 26) of the outer tank. The walls of the baffle extend fully between the end walls of the outer tank. This is a critical feature of the invention as it prevents turbulence from the rotation of the paddles within the outer tank. In addition, as there are no portions of the paddle drum system (20) inside the baffle (18), the media flows unimpeded through the outer tank carrying the coal from one end wall to the other end wall of the outer tank. The baffle is constructed of the same type of material as is the outer tank.

The size of the baffle opening (36) in the bottom of the baffle can be any size which permits the waste to fall through and preferably runs approximately a distance slightly less than the length of the baffle from one end wall to the other end wall of the outer tank and is about half the width of the outer tank.

Located on the opposite end of the outer tank from the inlet chute (32) is the discharge opening (40). See FIG. 3. The discharge opening (40) is an opening placed at a level just below the surface of the medium as it flows through the outer tank. The width of the discharge opening (40) is preferably approximately the width of the baffle. As the medium is forced through the outer tank by the pressure created at the inlet chute (32), the media with any material contained therein is forced through the discharge opening (40). After the material leaves the discharge opening, it passes onto a receiving system for further treatment of the material which has then been separated. This receiving system is conventional and need not be further discussed.

Figure 4:
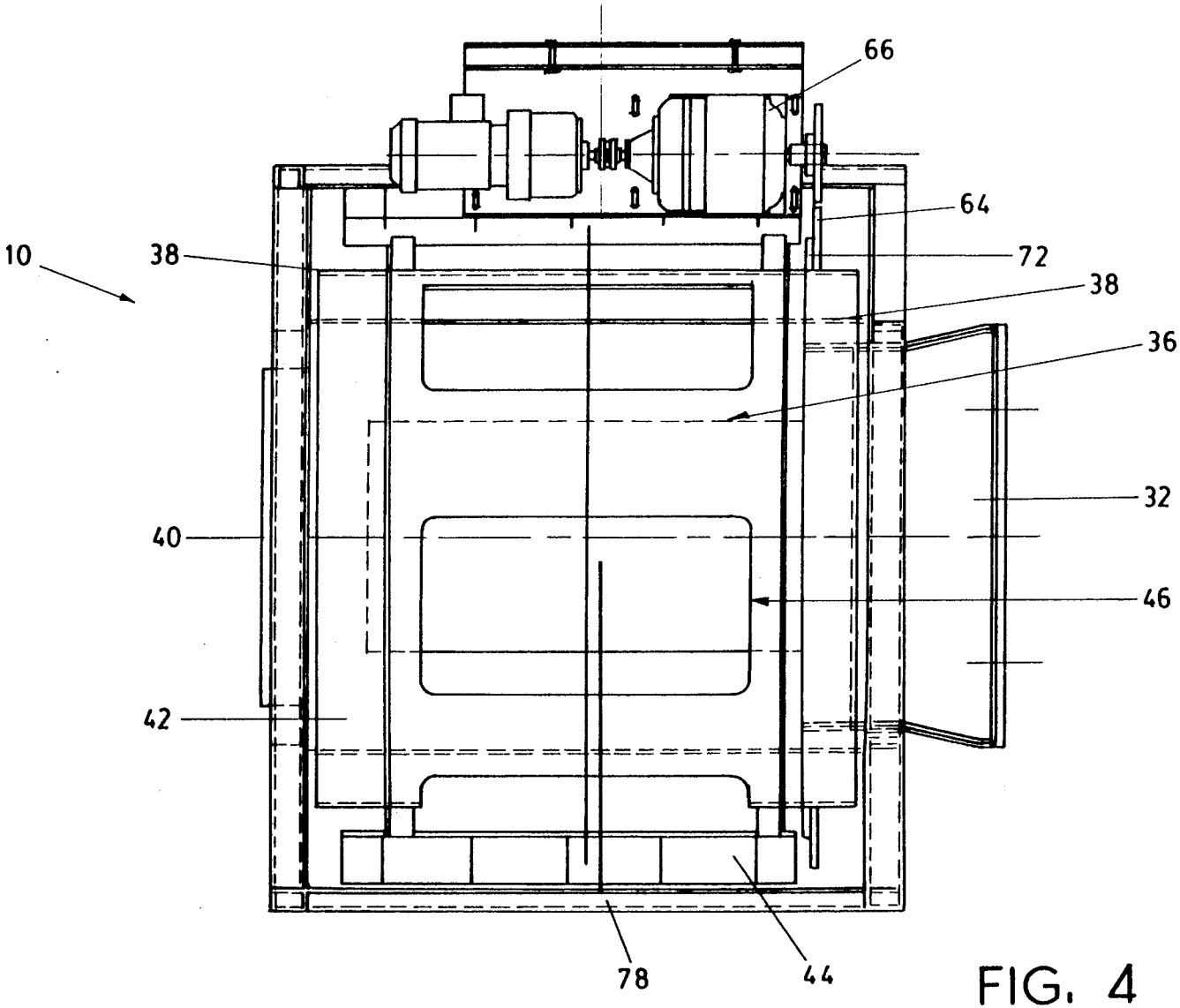
FIG. 4 is a top view of the device showing the discharge end on the left side and the inlet end on the right side.

Secured within the outer tank is the paddle drum system (20). The paddle drum system is comprised of a paddle drum (42) and a plurality of paddles (44) secured to the paddle drum. The paddle drum (42) is open at each end and is a generally cylindrical tube of lesser diameter than the outer tank (12) but greater diameter than the baffle (18). The paddle drum (42) has a number of paddle drum openings (46) which are generally rectangular in shape, approximately ⅔ the width of the drum. See FIG. 4. Each paddle (44) is secured to the surface of the paddle drum by a paddle securing system (48) preferably between the paddle drum openings. Each of these paddles (44) are generally the shape of a relatively thin scoop and are angled at from about 15° to about 60° from the paddle securing system (48). The paddles are slightly less wide than is the paddle drum (42) and preferably about 6–24 inches in height. All of the paddles (44) are angled in the same direction at approximately the same angle. The paddles are affixed to the paddle drum (42) by the paddle securing system (48) and preferably by securing each of them to a horizontal paddle securing tube (50) which is secured to a vertical paddle securing tube (52) at each end of said horizontal paddle securing tube (50) which is finally secured to the surface of the paddle drum (42). Any number of paddles (44) can be used but at least about 4 and preferably at least about 6 of the paddles are secured to the paddle drum (42). The paddles (44) and the paddle drum (42) are preferably made of the same type of material as is the outer tank.

Secured to the paddle drum and to the support system is the drive system for rotating and supporting the paddle drum (42) within the generally semi-tank (12). The drive support system (22) is comprised of a pair of end plates (54, 56), a plurality of support tubes (58) to support said end plates, a plurality of rotation bearings (60) with support wheels (62), sprocketed segments (64) and a drive motor system (66).

The end plates (54, 56) are generally semi-circular pieces secured to the support system (30) of the device. See FIG. 3. One end plate is secured on each end of the support system and is held securely in place by a plurality of support tubes (58), preferably three, secured to each end plate wherein the support tubes (58) pass through the paddle drum (42). By the combination of support of the end plates (54, 56) by the support tubes (58) running through the paddle drum (42) and the attachment of the end plates (54, 56) to the support system (30), the end plates are held securely in place.

Secured to the inside of each of the end plates are a plurality of rotation bearings (60) with supporting wheels (62). See FIGS. 2 and 3. At least two pairs of complimentary rotation bearings (68) with support wheels are secured to the inside of each end plate and preferably as many as six or more individual rotation bearings. The outside edge (70) of the paddle drum is placed between the wheels of each of the complimentary rotation bearings (68). As the paddle drum (42) rotates, it moves between or next to the wheels of some or all of these rotation bearings. The lower support wheels support the weight of the paddle drum while the upper support wheels prevent the paddle drum from riding up too high.

Figure 5:
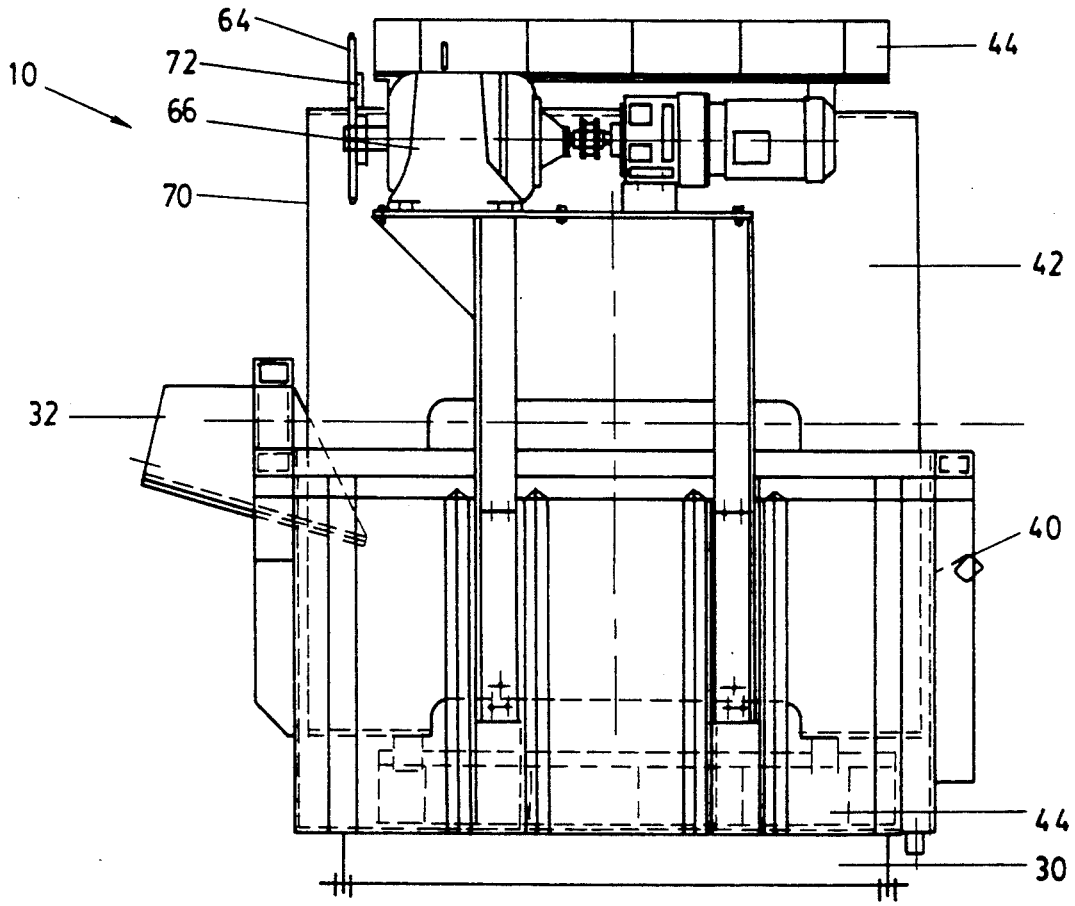
FIG. 5 is a side view of the device with the inlet end on the left side and the discharge end on the right side.

There is secured to the top surface of the paddle drum by welding a plurality of ears (72). Secured to these ears are the sprocketed segments (64) which extend from about 2 to about 6 inches from the surface of the paddle drum and contain teeth (74). These sprocketed segments (64) are secured to the ears by welding or by bolts. See FIGS. 4 and 5.

Attached to the support system of the device is the drive motor system (66). Although many different types of drive motor systems can be used, in a preferred embodiment the drive motor system is a sprocket drive attached to a speed reducer attached to a motor to rotate the paddle drum at variable speeds. The chain (76) from the sprocket drive runs over the teeth of the sprocketed segments to rotate the paddle drum. See FIG. 2.

The refuse from the bottom of the tank is removed from the tank by the action of the paddles. As the paddles rise to the edge of the tank, the refuse flows off of the paddles and down a refuse discharge section (78) to be processed by conventional refuse disposal procedures. The refuse discharge section can be any conventional chute or tray attached to the side of the outer tank. See FIG. 4.

In operation, coal or other material to be separated is introduced in the inlet chute (32) and propelled into the medium by the medium introducing system (16). The material is propelled across the media in the outer tank (12) by the force of the media being introduced through the medium introducing system (16). The heavier or higher specific gravity material drops to the bottom of the outer tank (12) while the lighter material is propelled across the media to the discharge opening (40). All or substantially all of the lighter weight material stays within the media because of the walls of the baffle (38) which extend from one end to the opposite end of the outer tank (12). The heavier material falls to the bottom of the baffle and then slides through the baffle opening (36) to congregate on the bottom of the outer tank. The lighter weight material is discharged through the discharge opening (40) for later processing. The heavier material which falls to the bottom of the outer tank is disposed with other waste materials through the refuse discharge section (78) by use of the paddle drum system (20) propelled by the drive support system (22).

The paddles (44) which are secured to the paddle drums (42) are rotated by the operation of the paddle drive system (20). The drive motor system (66) rotates a chain (76) which is attached to the sprocketed segments (64) which are secured to the outer surface of the paddle drum (42). The paddle drum (42) is rotated between and next to the rotation bearings (60) with support wheels (62). As the drum is rotated, the paddles (44) push the refuse from the bottom of the outer tank (12) out to the refuse discharge section (78) for disposal.

I claim:

1. An apparatus for separating material of lighter specific gravity from a material of heavier specific gravity contained in a media comprising (a) an outer tank comprised of end walls and a semi-cylindrical portion, wherein said outer tank is supported by a support system, (b) a baffle containing walls and a baffle opening, wherein said baffle is secured within said outer tank, wherein said walls of said baffle project above the surface of media placed within the outer tank when said tank is filled with said media, and wherein the walls of said baffle extend between the end walls of the outer tank, (c) a paddle drum means supported within the outer tank on an axis parallel to the longitudinal axis of the outer tank and the baffle wherein said paddle drum means is comprised of a paddle drum containing openings and a plurality of paddles secured to said paddle drum, wherein said paddle drum means does not project inside the walls of the baffle, (d) a drive support means secured to the support system and the paddle drum means wherein said drive support means rotates and supports the paddle drum means, (e) A medium introducing means for introducing the medium into said outer tank wherein said material introducing means is secured to said outer tank, wherein the flow of the media runs parallel to the plurality of paddles of the paddle drum means and parallel to the walls of the baffle such that the interruption in the medium by the action of the paddle drum means is limited, and (f) A material introducing means for introducing the material to be separated into said outer tank wherein said material introducing means is secured to said outer tank wherein said material introducing means introduces the material into the flow of the media whereby said material will flow parallel to the plurality of paddles which are secured to the paddle drum and parallel to the walls of the baffle, wherein the interruption in the flow of the material in the media by the paddles of the paddle drum is limited.

2. The apparatus of claim 1 wherein the baffle contains upwardly extending walls wherein said baffle is secured within the outer tank to the end walls and wherein there is a baffle opening in said baffle.

3. The apparatus of claim 1 wherein the drive support means is a pair of end plates with a plurality of support tubes supporting said end plates, a plurality of rotation bearings with support wheels secured to said end plates and a drive motor system.

4. The apparatus of claim 1 wherein there is secured to the outside of said paddle drum a series of ears and attached to those ears are sprocketed segments.

5. The apparatus of claim 1 wherein the generally cylindrical outer tank is constructed from at least about ½ inch thick, abrasion resistant steel.

6. The apparatus of claim 1 wherein the material introducing means is an inlet chute about ⅓ to about ⅔ the width of one end of the outer tank wherein said inlet chute is angled downwardly at an angle of at least about 10° to about 45°.

7. The apparatus of claim 6 wherein the medium introducing means is comprised of a plurality of medium introducing openings in one end wall of the outer tank and secured to said openings is a system for the introduction of media into the outer tank.

8. The apparatus of claim 7 wherein the media introduced into the outer tank is a mixture of water and magnetite.

9. The apparatus of claim 6 wherein the outer tank contains a discharge opening in one end wall of the tank opposite the inlet chute.

10. The apparatus of claim 1 wherein the paddle drum is a generally cylindrical tube of a diameter less than the generally cylindrical outer tank with both ends open and with openings in the side of the paddle drum.

11. The apparatus of claim 1 wherein the paddles are angled at an angle of at least about 15° to about 60° from a perpendicular to the surface of the paddle drum where the paddle is secured to the paddle drum.

12. The apparatus of claim 1 wherein there is secured to the outer tank a refuse discharge section.

13. The apparatus of claim 7 wherein a portion of the media introduced into the outer tank is introduced through medium introducing openings in one of end walls of the outer tank adjacent to the inlet chute.

14. The apparatus of claim 9 wherein the discharge opening is placed at a level slightly below the surface of the media when the outer tank is filled with media.

15. The apparatus of claim 1 wherein there are at least about 6 paddles secured to the paddle drum.

* * * * *